United States Patent [19]

Rodgers

[11] Patent Number: 5,028,140

[45] Date of Patent: Jul. 2, 1991

[54] METHOD AND APPARATUS FOR THE INTIMATE MIXING OF FLUIDS

[76] Inventor: William Rodgers, 39-41 Fitzpatrick Street, Revesby, New South Wales 2212, Australia

[21] Appl. No.: 442,326

[22] PCT Filed: Mar. 1, 1989

[86] PCT No.: PCT/AU89/00081

§ 371 Date: Oct. 31, 1989

§ 102(e) Date: Oct. 31, 1989

[87] PCT Pub. No.: WO89/08494

PCT Pub. Date: Sep. 21, 1989

[30] Foreign Application Priority Data

Mar. 8, 1988 [AU] Australia ..... PI7162

[51] Int. Cl.[5] ..... B01F 5/02; B01F 15/02

[52] U.S. Cl. ..... 366/165; 366/101; 55/238; 55/259; 55/261; 261/79.2

[58] Field of Search ..... 366/348, 349, 336, 337, 366/338, 339, 340, 165, 101, 102, 106, 107; 261/79.2; 55/259, 261, 238, 416

[56] References Cited

U.S. PATENT DOCUMENTS

| | | | |
|---|---|---|---|
| 2,873,815 | 2/1959 | Swayze | 55/261 |
| 4,157,368 | 6/1979 | Fernandes | 261/155 |
| 4,179,222 | 12/1979 | Strom | 366/337 |

*Primary Examiner*—Robert W. Jenkins

*Attorney, Agent, or Firm*—Edwin D. Schindler

[57] ABSTRACT

A method for intimately mixing fluids in a two-stage process is disclosed. The method includes the steps of subjecting a continuous flow of an aggregation of fluids to free vortex flow, having axial and tangential velocity components, and then substantially removing the tangential velocity component to substantially recover the tangential velocity energy so as to provide a discharge flow which is substantially axial.

3 Claims, 1 Drawing Sheet

METHOD AND APPARATUS FOR THE INTIMATE MIXING OF FLUIDS

Figure 1:
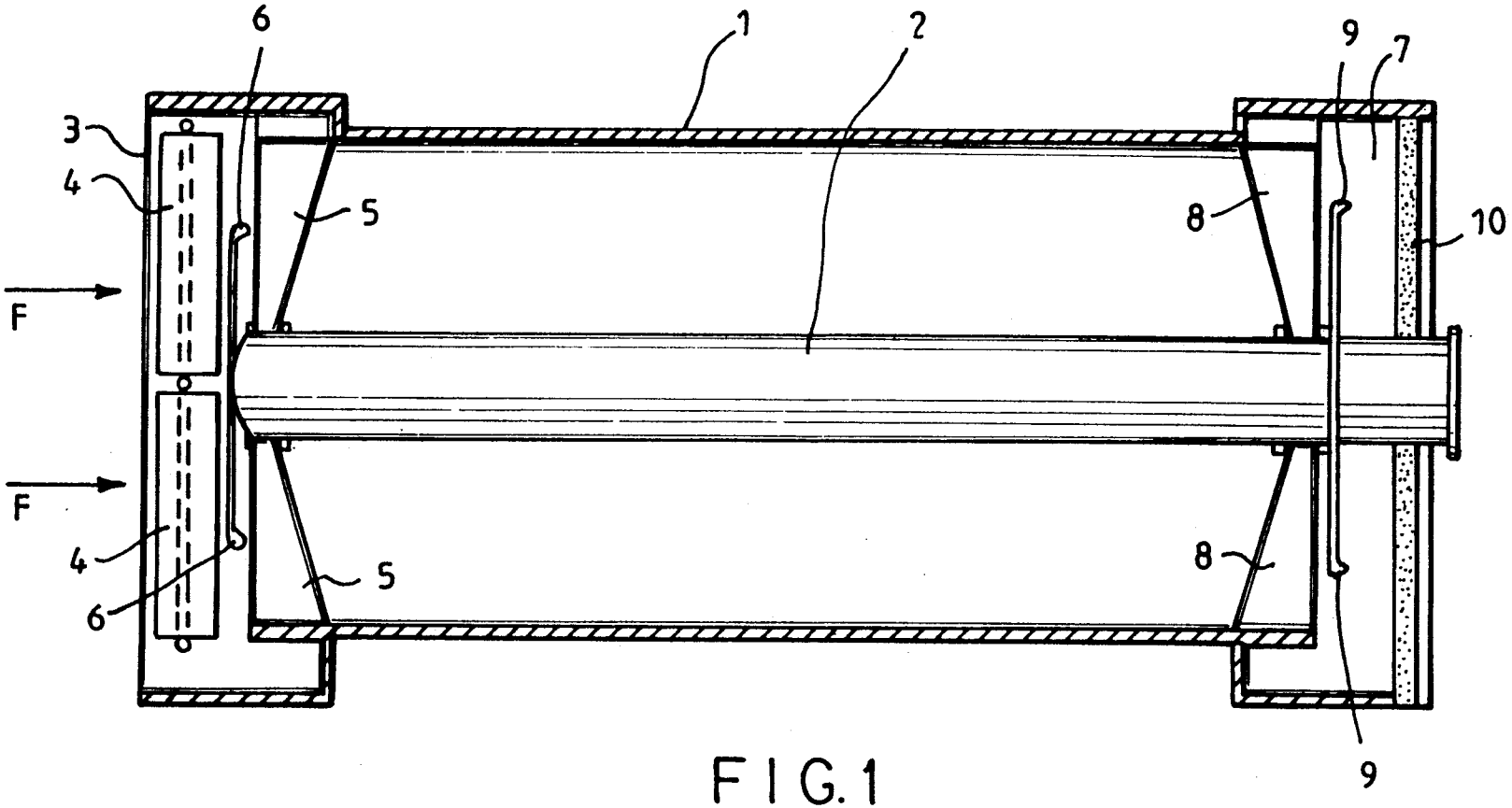

This invention relates to the mixing of fluids and provides an improved method and apparatus for carrying out intimate mixing of fluids.

In industrial chemical processes it is important that the components for a chemical reaction be intimately and thoroughly mixed in order that the chemical reaction can be completed. This invention has as its object the achievement of the foregoing particularly as applied to the intimate mixing of liquid droplets with a pressurised gas flow. It is a further object of the invention to carry out the mixing operation with minimum pressure loss. It is to be understood that the invention is also applicable to the mixing of gases and the mixing of liquids.

The term free vortex flow, as used hereinafter, means a rotating flow in which there is present axial and tangential velocity components and wherein the tangential velocity component in greatest at the axis of the flow and decreases with radial distance from the axis.

Broadly, the invention provides a method of intimately mixing fluids in a two stage process comprising the steps of subjecting a continuous flow of an aggregation of fluids to free vortex flow having axial and tangential velocity components as hereinbefore defined and then substantially removing the tangential velocity component to recover the tangential velocity energy and to provide a discharge flow which is substantially axial.

The invention further comprises apparatus for carrying out the above method wherein the apparatus includes a fluid passageway with an inlet end and a discharge end and at least a vortex zone and a axial flow zone downstream from said vortex zone, vortex flow promoting guide vanes extending into said fluid passageway in said vortex zone shaped and disposed to promote free vortex flow with axial and tangential velocity components as hereinbefore defined in fluids passing through said vortex zone and axial flow promoting guide vanes extending into said fluid passageway in said axial flow zone shaped and disposed to substantially remove tangential velocity and recover the tangential velocity energy from fluid passing through said axial flow zone and thereby provide substantially rotation fee fluid discharge from said discharge end of said device.

The vortex promoting guide vanes may be part of an assembly which is driven and rotates about the axis of the vortex flow to impart energy to the vortex flow.

A representative example of an apparatus for carrying out the invention will now be described with reference to the accompany schematic partially sectioned elevation of a deodorising unit for sewer gas.

The apparatus comprises an annular chamber 1 with a centrally mounted hub 2. The chamber has an inlet end 3 fitted with flow control louvres 4 (these are not essential to the operation of the apparatus) and a pressurised gas flow F from a suitable source enters the chamber 1 through the end 3.

Adjacent the end 3 there are a number of equally circumferentially spaced radially oriented guide vanes or blades 5 (hereinafter referred to as vanes) which are twisted in a predetermined manner along their lengths so as to impart a rotational velocity to the axially flowing gas. The shaping of the vanes 5 promotes rotational flow as a free vortex flow in a vortex zone where the tangential velocity component of flow is greatest adjacent the centre of the chamber and descreases with radial distance from the centre of the chamber. The creation of the tangential velocity in the gas flow utilises some of the energy from the gas flow and there is a corresponding pressure drop downstream from the guide vanes 5 as the tangential velocity of the gas flow increases through the vanes 5.

Upstream from the vanes 5 there are misting jets 6 to introduce chlorine dioxide into the sewer gas flow. The vortex flow of gas creates an intimate mix of sewer gas and chlorine dioxide as it progresses as a swirling mass towards the exit end 7 of the chamber. The intimate mixing ensures a complete chemical reaction between the chlorine dioxide and the hydrogen sulphide in the sewer gas (the offensive smell component of the sewer gas) and the desired result is the formation of solid sulphur particles which are entrained in the gas flow.

Adjacent and upstream from the exit end 7 of the chamber 1 there is an axial flow zone provided with guide vanes 8 shaped to substantially remove the tangential velocity component of the gas flow created by the guide vanes 5 and the result is a substantially rotation fee axial gas flow from exit end 7 of the chamber 1. There is an associated recovery of energy from the gas flow and a pressure increase as the gas flow passes through the vanes 8 and there is a corresponding decrease in the tangential flow velocity. Preferably the vanes 8 have a shape, orientation and spacing substantially complementing that of the vanes 5. As will be understood that vanes 5 and 8 may have any shape, orientation and spacing which will impart to and remove from the fluid flow the tangential velocity required for the intimate mixing process and the recovery of energy.

To prevent the sulphur particles entrained in the gas flow from exiting to atmosphere a sulphur trap is provided in the form of water sprays 9 and a mist trap 10. The sulphur particles in water suspension is then treated in a manner not forming part of this invention. The result is a discharge from the apparatus of a substantially axial flow of clean odour free air.

I claim:

1. A method for intimately mixing a first fluid and a second fluid, comprising the steps of:

(a) providing an elongated mixing chamber having:
  a fluid inlet and a fluid outlet;
  first means adjacent the mixing chamber fluid inlet for inducing a free vortex flow in a fluid passing through said first means; and,
  second means adjacent the mixing chamber fluid outlet for removing free vortex forming velocity components from fluid passing through said second means;

(b) directing a pressurized, substantially axial flow of fluid into the mixing chamber through the fluid inlet;

(c) passing said axial fluid flow into said first means for imparting to said fluid flow tangential velocity components sufficient to create a free vortex flow within said mixing chamber downstream from said first means;

(d) introducing a second fluid into said fluid flow at a position juxtaposed said first means to form a fluid mix;

(e) passing said free vortex flow of mixing fluids directly along said chamber to said second means;

(f) passing said free vortex flow through said second means to substantially remove vortex forming tangential velocity components from said fluid flow; and, (g) discharging said fluid flow from said mixing chamber through said outlet as a substantially axial flow.

2. The method for intimately mixing a first fluid and a second fluid as claimed in claim 1, further comprising the step of introducing sewer gas as the first fluid and chlorine dioxide as the second fluid.

3. The method for intimately mixing a first fluid and a second fluid as claimed in claim 1, further comprising the step of washing the fluid mix immediately before said discharging step through the mixing chamber outlet extracts solids from the fluid mix.

* * * * *